US005717659A

United States Patent [19]

Besesty

[11] Patent Number: 5,717,659

[45] Date of Patent: Feb. 10, 1998

[54] DEVICE FOR MEASURING THE DURATION OF A TIME SLOT

[75] Inventor: Pascal Besesty, Vaulnaveys Le Haut, France

[73] Assignee: Commissariat a L'Energie Atomique, France

[21] Appl. No.: 531,377

[22] Filed: Sep. 21, 1995

[30] Foreign Application Priority Data

Oct. 4, 1994 [FR] France ..... 94 11848

[51] Int. Cl.[6] ..... G04F 8/00; G04P 10/00

[52] U.S. Cl. ..... 368/113; 368/119

[58] Field of Search ..... 368/113–120

[56] References Cited

U.S. PATENT DOCUMENTS

| | | | |
|---|---|---|---|
| 3,934,400 | 1/1976 | Nishimura et al. | 58/23 |
| 4,912,734 | 3/1990 | Frauenglass | 377/20 |
| 5,200,933 | 4/1993 | Thornton et al. | 368/113 |
| 5,319,614 | 6/1994 | Hayashi | 368/113 |
| 5,325,340 | 6/1994 | Ramsey | 368/3 |
| 5,570,326 | 10/1996 | Trystram | 368/113 |

FOREIGN PATENT DOCUMENTS 2422727 12/1974 Germany .

OTHER PUBLICATIONS

Baron, "The Vernier Time Measuring Technique", 1957, pp. 21–30; IRE.

U.S. Patent Application Serial No. 08/259,714 filed Jun. 14, 1994 corresponding to FR–93 08145; Inventor: Philippe Trystram.

*Primary Examiner*—Bernard Roskoski
*Attorney, Agent, or Firm*—Hayes, Soloway, Hennessey, Grossman & Hage, P.C.

[57] ABSTRACT

A device for measuring the duration of a time slot or interval includes a first clock for supplying pulses of period T and a second clock, whose pulses are shifted with respect to the first. A digital circuit counts the number of pulses of the clocks, which are followed by a complete period T and which occur between the start signal and the stop signal. An analog circuit determines the times separating the start signal and the start of the first pulses of the clocks after the start signal and the times separating the stop signal and the end of the final periods of the clocks before the stop signal, and converts the analog data into digital data. A processing circuit determines the duration of the time slot, and resolves any ambiguity situation, which could lead to a clock period counting error.

18 Claims, 4 Drawing Sheets

DEVICE FOR MEASURING THE DURATION OF A TIME SLOT

TECHNICAL FIELD

The present invention relates to a device for measuring the duration of a time slot or interval.

The field of the invention is that of chronometry, the precise time measurement of a short or infinitely long time period between a measurement start and measurement stop signal.

This type of problem occurs in all devices where a precise time measurement is necessary over very long periods, particularly in devices used in the field of laser telemetry.

PRIOR ART

In the field of very accurately measuring time use is made:

either of averaging methods, which considerably increase the acquisition time compared with the measuring time: such methods not being usable in the case where the acquisition time must be limited and also averaging is only possible if the measured phenomenon has an appropriate stationarity relative to the averaging time;

"vernier" methods, which are based on the counting of the periods of a clock for a rough measurement and on the determination of a time compliment by an analog method which gives the accuracy to the measurement: such a method being described in the article entitled "The vernier time-measuring technique" by Robert G. Baron (proceedings of the IRE, January 1957), but this method lengthens significantly the measuring time (5 μs measurement time for a resolution of 20 μs with 100 megahertz clocks), so that it limits the number of possible measurements well below the implementation frequency of certain events.

The French patent application filed under No. 93 08145 on Feb. 7, 1993 and entitled "Device for measuring the duration of a time slot" describes a process for measuring time making it possible to remove the counting ambiguity of a clock stroke and which takes account of non-synchronism problems. This process is not suitable for measuring long time durations exceeding 10 us, as a result of the discharge of a capacitor of the circuit which can lead to a significant error on long measurement intervals, particularly for medium distance telemetry applications (exceeding 1 km).

DESCRIPTION OF THE INVENTION

The invention aims at solving these problems.

More specifically, it relates to a device for measuring the duration of a time slot between a start signal (D) and a stop signal (F), characterized in that it comprises:

a first clock supplying pulses with a period T, a digital circuit for counting the number of pulses of the first clock followed by a complete period T and which are between the start signal (D) and the stop signal (F), an analog signal for determining on the one hand the time $t_1$ separating the signal (D) and the start of the first pulse of the other clock commencing after (D) and on the other hand the time $t_2$ separating the stop signal (F) from the end of the final period of the first clock completed before (F), and able to convert the analog data obtained into digital data, a processing circuit for determining the duration of the time slot on the basis of data supplied by the digital circuit and those supplied by the analog circuit previously converted into digital data.

This device makes it possible to very accurately measure very long time intervals or slots. Moreover, the start (D) and stop (F) signals can be completely clock-asynchronous. This is interesting for applications of the "flight time" telemetry type, in which (D) and (F) are given by the start of a light pulse and by the reception of the pulse reflected on an object, whereby said two signals (D) and (F) can be asynchronous with respect to the clock.

According to a special embodiment of the invention, the analog circuit can also comprise:

a frequency dividing circuit connected to the first clock, a first ramp generator controlled by the output signal of the frequency dividing circuit, and a first analog-digital converter receiving on the one hand the signal produced by the first ramp generator and on the other the start (D) and stop (F) signals of the time slot to be measured.

According to another embodiment of the invention, the digital circuit is provided with a second clock, whose pulses are shifted with respect to those of the first clock, the digital circuit also counting the number of pulses of the second clock followed by a complete period and which occur between the start signal (D) and the stop signal (F), the analog circuit determining on the one hand the time separating the signal (D) and the start of the first pulse of the second clock commencing after (D) and, on the other hand, the time separating the stop signal (F) from the end of the final period of the second clock completed before (F), said analog circuit being able to convert the analog data obtained into digital data and the device also has means able to determine which of the counts performed on one of the two clocks ($H_1$, $H_2$) is to be taken into account, so as to resolve any ambiguity situation which could lead to a clock period counting error.

Thus, it is possible to remove any ambiguity situation in the case where one of the signals (D) and (F) coincides with a clock pulse.

Other aspects and embodiments can be gathered from the dependent claims.

BRIEF DESCRIPTION OF THE DRAWINGS

The invention is described in greater detail hereinafter relative to non-limitative embodiments and with reference to the attached drawings, wherein show.

DETAILED DESCRIPTION OF EMBODIMENTS

In order to measure the duration of a given time interval or slot, according to the invention, measurement takes place of the rough part of the time slot in digital manner and the fine part in analog manner. The thus acquired parameters are then recombined in order to obtain the result. Therefore the time measurement is obtained by associating a digital quantity in the form of a number of counted clock periods and analog quantities obtained by converting times into voltage amplitudes.

Figure 1:
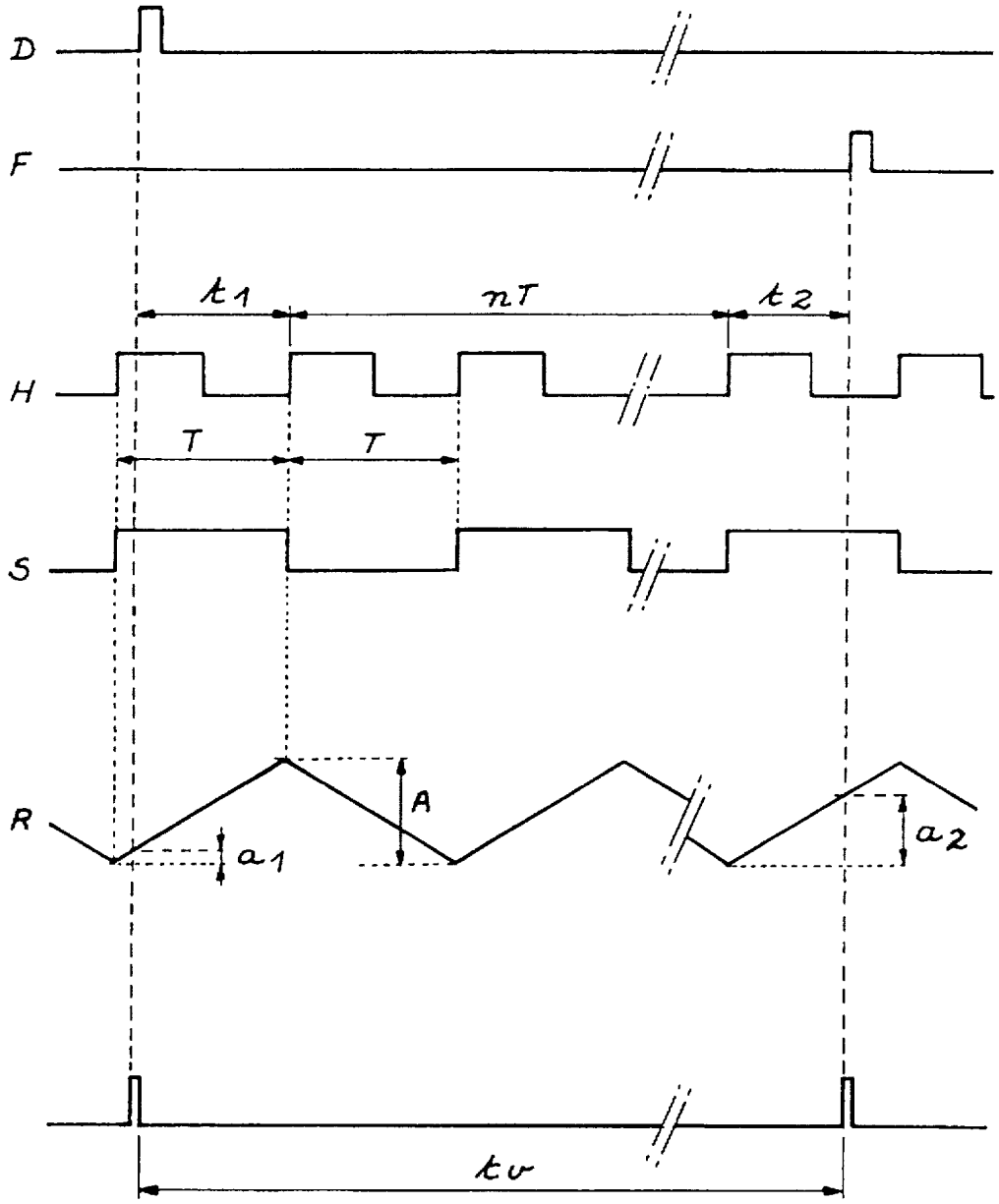
FIG. 1 The measuring principle of a time slot according to the invention.

This principle is illustrated with the aid of the timing diagram of FIG. 1. The aim is to measure the time slot $t_v$ between the interval start pulse D and the interval stop pulse to be measured F. For this purpose use is made of a basic clock H of period T. The number of clock pulses n followed by a complete period T is counted for the duration $t_v$. The total time corresponding to the passing of this period is equal to nT. As the clock is not synchronous with the start signal D and stop signal F, it is also necessary to determine on the one hand the time $t_1$, elapsing between the start signal D and the beginning of the first clock pulse commencing after D1 and, on the other hand, the time $t_2$ elapsing between the stop signal F and the end of the final clock period completed before the signal F. To obtain the duration of the time slot $t_v$, it is then merely necessary to add the three measured times: $t_1+nT+T_2$.

To determine $t_1$ and $t_2$ use is made of a triangular signal R of period 2T, amplitude A and synchronous with the basic clock of period T. At any instant, if a is the amplitude measured on the ramp, the t elapsed since the start of the ramp is equal to A/T.a. By sampling the ramps on the appearance of the start signal D and the stop signal F, amplitudes $a_1$ and $a_2$ are obtained, which respectively respresent $t_1$ and $t_2$.

If the starting pulse occurs during a rising ramp, we obtain:

$$t_1 = \frac{T}{A} \cdot a_1.$$

If the starting pulse occurs during a falling ramp, we obtain:

$$t_1 = T - \frac{T}{A} \cdot a_1.$$

If the stop pulse F occurs on a rising ramp, we obtain:

$$t_2 = \frac{T}{A} \cdot a_2.$$

If the stop pulse F occurs on a falling ramp, we obtain:

$$t_2 = T - \frac{T}{A} \cdot a_2.$$

$t_1$ and $t_2$ are then digitized, which gives two corresponding values $T_1$ and $T_2$. Thus, the duration of the time slot is obtained: $t_v=nT+T_1+T_2$.

Figure 2:
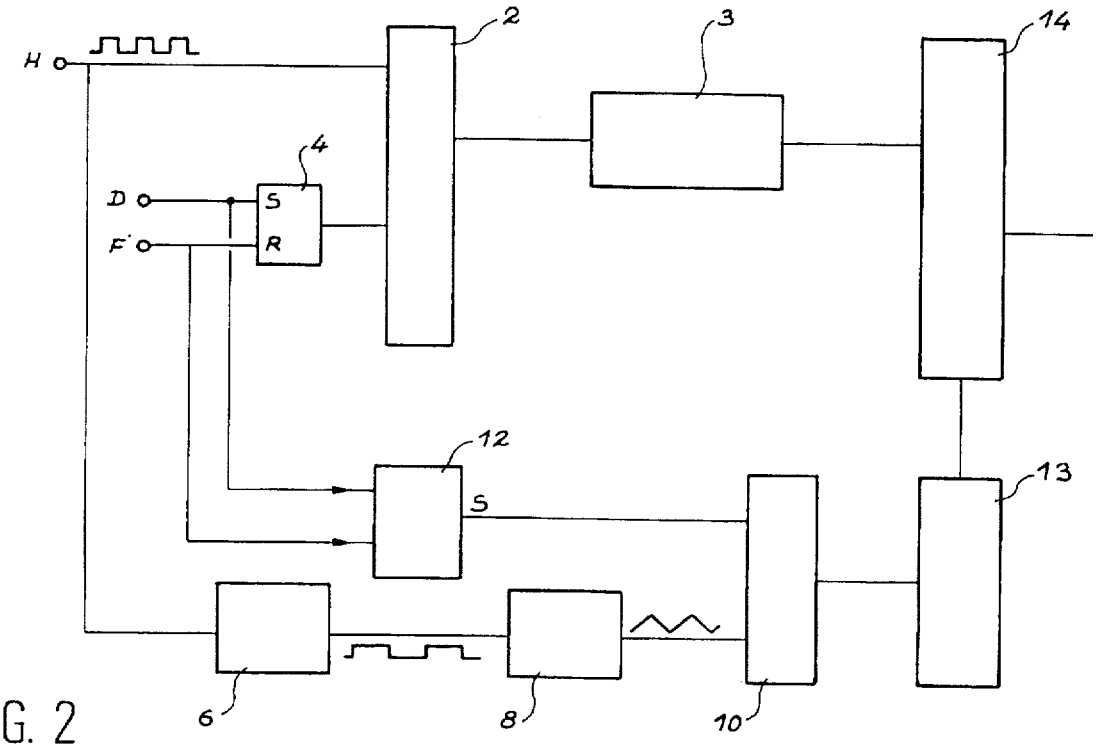
FIG. 2 A diagram of a device for performing the invention.

A device for performing the invention is shown in FIG. 2. A clock H supplies pulses of period T to one of the inputs of an AND gate, designated by the reference 2. This clock H can be produced from a crystal quartz oscillator operating e.g. at a frequency of 200 MHz. The other input of the AND gate receives a signal from the output Q of a R-S flip-flop designated by the reference 4, to whose input S is supplied the start signal D, whilst the input R is controlled by the stop signal F. The unit constituted by the AND gate, flip-flop 4 and clock H constitutes a digital measuring circuit making it possible to obtain a rough value of the time slot to be measured. This value is equal to nT, in which n is the number clock periods T which have elapsed between the start signal D and the stop signal F and is counted in a counter 3.

In parallel, a division of the frequency of the signals of the clock H is performed by a divider 6, e.g. formed by a flip-flop, the output of said divider supplying a ramp generator 8. This generator can be implemented by the constant current charging and discharging of a capacitor. The period and gradient of these ramps are very well defined. The output of the ramp generator 8 is supplied to a fast analog-digital converter 10 (e.g. of the flash type or fast sampler+converter), whereof another input receives a signal e.g. from a flip-flop 12, controlled by the start signal D and stop signal F of the period to be measured. Thus, the converter 10 samples the information on the amplitude of the ramp at the start time D and stop time F of the time slot to be measured, as well as the information relative to the parity of the ramp at these instants, i.e. its rising or falling character. This converter makes it possible to obtain information concerning the values $T_1$ and $T_2$ and which is stored in a memory 13.

The rough information relating to nT and the "fine" information relating to the slots $T_1$ and $T_2$ are supplied to a processing circuit 14, which calculates the duration $t_v$ of the time slot to be measured.

This device makes it possible to obtain a good precision, because it gives freedom from any synchronization of the measurement start signal D and stop signal F relative to the timer or chronometer clock H. It also makes it possible to obtain freedom from the limited capacity of the chronometer for determining a small and a very long time deviation able to vary between a few seconds and infinity, due to the fact that its frequency is fixed.

This device also makes it possible to determine long time intervals with a constant precision, no matter what the duration of said time interval. This is not true in the case of the prior art time slot duration measuring devices, particularly that described in French patent application 93 08145 of Feb. 7, 1993. Thus, the latter device a capacitor is discharged at the start of the measurement of the time slot and at the end of said measurement the same capacitor is charged. However, the charge measured immediately after the arrival of the signal D can vary before reaching the final part of the time slot to be measured, just prior to the stop signal F and this increases as the time slot to be measured lengthens. In the device according to the invention, this problem is avoided by using recurrent ramps.

Finally, this type of device can easily be integrated in order to bring about a compact circuit.

An embodiment of the invention makes it possible to take account of problems linked with ambiguity situations on the start signal D and the stop signal F. These problems arise when one or other of the signals occur simultaneously at a rising or falling front or edge of the signals of the clock. The counter of the digital part of the device, which determines the rough measurement of the time slot, can then count a supplementary clock pulse, which would not have been counted.

Figure 3:
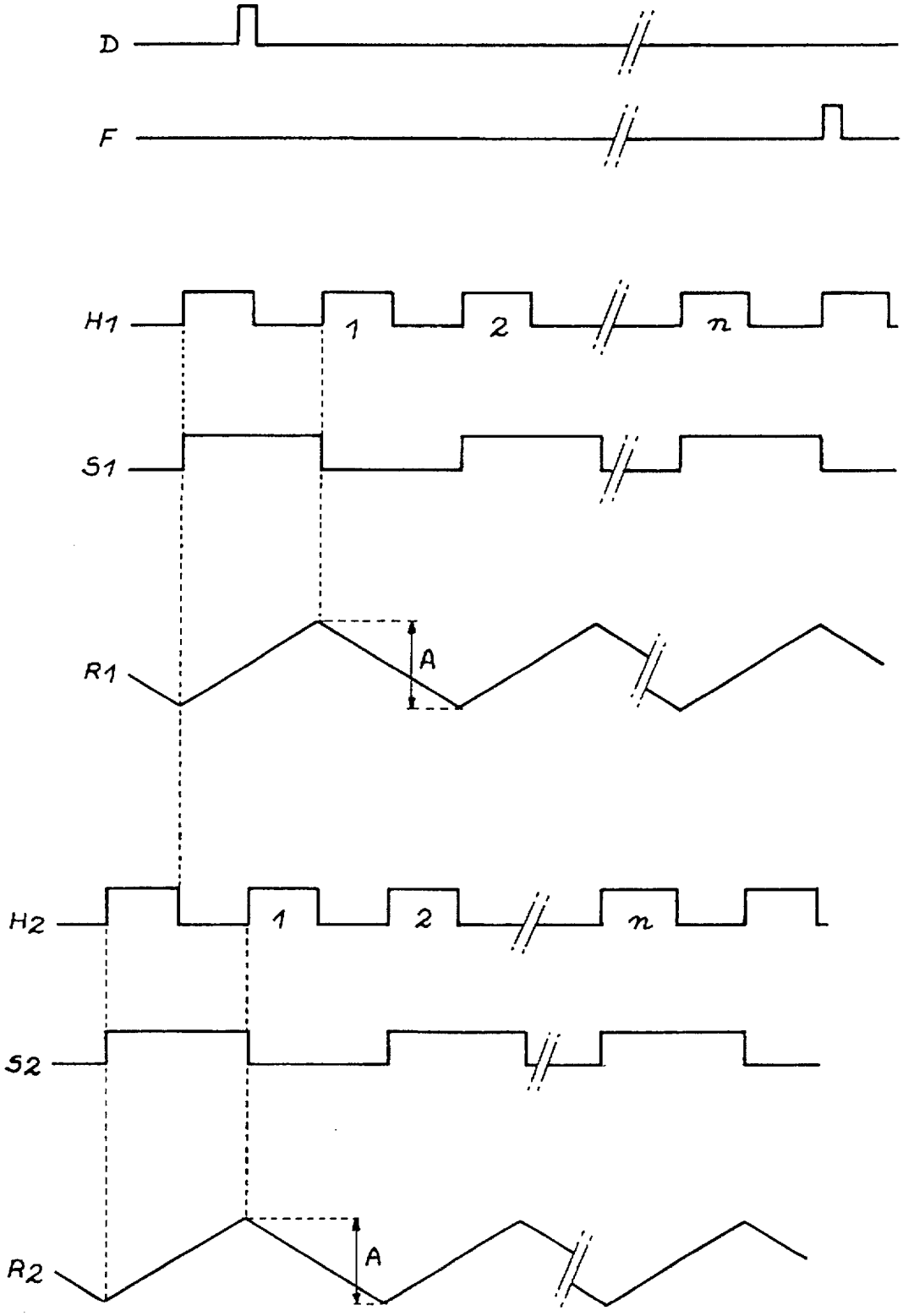
FIG. 3 The principle of the method according to a particular embodiment in the invention, in the case where ambiguity situations must be removed.

So as to solve this problem, the invention proposes a device operating on the principle illustrated in FIG. 3. In accordance with what has already been explained hereinbefore, a clock $H_1$ supplies signals of period T. A divider makes it possible to generate signals $S_1$ of period 2T synchronized with the signals of the clock $H_1$. It is thus possible to generate rising and falling ramps $R_1$ of amplitude A. A delay or lag device makes it possible to generate a second signal of clock $H_2$, on the basis of the signal $H_1$, the signals $H_2$ being shifted by T/2 with respect to the signals of $H_1$. Thus, a falling edge of a square wave pulse of $H_2$ corresponds to a rising edge of a square wave pulse of $H_1$, as can be seen in FIG. 3. This signal of clock $H_2$ makes it possible to generate in the manner described hereinbefore for clock $H_1$, a signal $S_2$ of period 2T, which will itself control a ramp $R_2$ of the same amplitude A as the ramp $R_1$. When the measurement start signal D occurs, simultaneous sampling takes place of the two ramps $R_1$ and $R_2$. If there is e.g. ambiguity between D and $H_1$, i.e. if the signal D is superimposed on a rising edge of a square wave pulse of $H_1$, it is not possible for there to be simultaneously ambiguity between the signal D and the signals generated by $H_2$, due to the shift by a half-period between the two channels. Consequently, it is merely necessary to identify the clock which is not in an ambiguity situation with the start signal D and to then only retain the sampled value of the corresponding ramp R in order to determine $t_1$. For example, if the ambiguity situation occurs between the start signal D and the clock $H_1$, the valid clock for determining the measurement of $t_1$ is the clock $H_2$ and the value to be taken into account is that measured on the ramp $R_2$.

The same situation occurs for any ambiguity on the signal F. When the stop signal F occurs, simultaneous sampling takes place on the two ramps $R_1$ and $R_2$. For $t_2$ is taken the value of the ramp $R_1$ or $R_2$ from the clock $H_1$ or $H_2$ not having an ambiguity with the signal F.

In the case where the ambiguity situation exists simultaneously on D and F, it is possible to add a third circuit with a clock $H_3$ shifted with respect to $H_2$ and $H_1$.

In the case where there is no ambiguity, neither with the clock $H_1$, nor with the clock $H_2$, the time values obtained ($t_1$ or $t_2$) will be taken on one or other of the two circuits corresponding to the two clocks.

Figure 4:
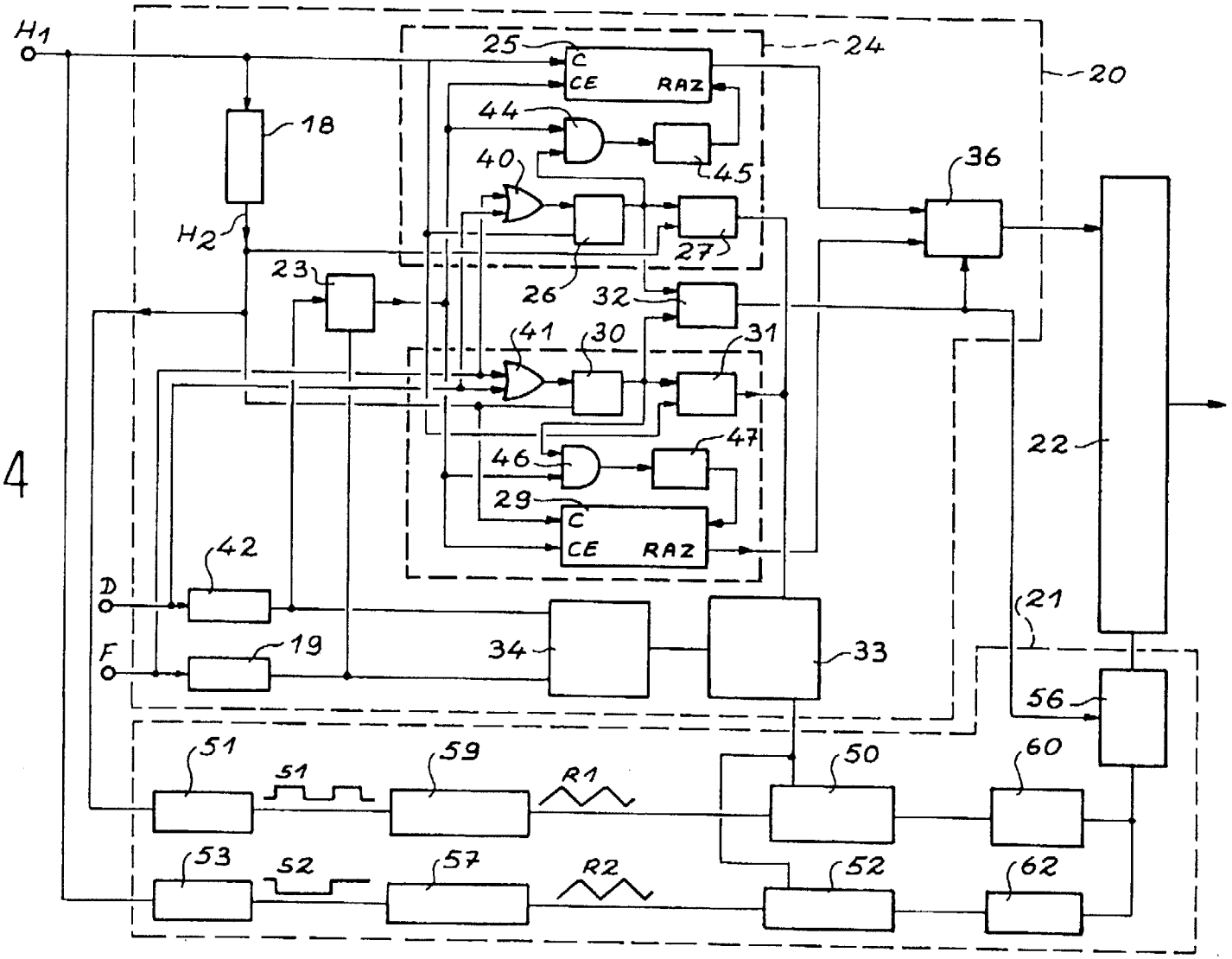
FIG. 4 A diagram of another device for performing the invention according to a second embodiment.

The device corresponding to this embodiment of the invention is illustrated in FIG. 4, where in a first block 24 a first counter 25 receives on its authorization input CE a counting order from a flip-flop 23 and on its input C the signals of clock $H_1$. The output data from the first counter 25 are transmitted to a processing circuit 22 by means of a switching or routing circuit 36 controlled by an OR gate 32.

The D-flip-flops 26 and 30 receive the signals D and F by means of an OR function 40, 41 on their input D. The flip-flop 23, which supplies the authorization signal CE is also controlled by the signals D and F, which are both delayed by a quantity close to three propagation times in the gates by the devices 19, 42, which are e.g. constituted by time lags in the logic gates. The first AND gate 27 implements the AND function of the output of the flip-flop 26 and the clock $H_2$. The signals of the latter are obtained from $H_1$ and a lag circuit 18, e.g. constituted by propagation times in the gates.

In the second block 28 a second counter 29 receives on its authorization input CE a counting order from flip-flop 23. The data of said counter 29 are transmitted to the processing circuit 22 via the circuit 36. The second D-flip-flop 30 functions in the manner described hereinbefore. The second AND gate 31 implements the AND function between the output of the circuit 30 and the clock $H_1$.

The output of the circuit 32 controls the operation of the switching or routing circuit 36 to obtain the reading of the counter 25 or 29, whose D-flip-flop 26 or 30 has not switched first. It detects the first of the flip-flops 26 or 30 which has switched and it authorizes the reading of the counter, whose flip-flop has not changed state.

If there is an uncertainty situation, e.g. at the start of the count, for one or other of the counters, the first of the presence identification circuits 26, 30 which switches validates the choice between the clocks $H_1$ or $H_2$. The validated counter is left unchanged, whereas the other counter is zeroed prior to the arrival of the second clock pulse following the signal D. This is carried out by the circuits 44, 45 and 46, 47 respectively for the first and second counters. The circuits 44 and 46 are AND gates, whereas circuits 45 and 47 are of the time shaping type.

A R-S-flip-flop 33 receives on its set input the output of an OR gate 34, whereof the inputs correspond to the signals D and F delayed by the circuits 42 and 19. The flip-flop 33 receives on its other input the outputs of the two AND gates 27, 31.

This flip-flop 33 controls an input of an analog-digital converter 50 and an input of an analog-digital converter 52. Another input of each of these converters 50, 52 is connected to the clock $H_1$, respectively $H_2$ by means of a flip-flop 51, respectively 53, which makes it possible to generate a signal $S_1$, respectively $S_2$ of period 2T, and a ramp generator 59, respectively 57, for generating a ramp R1, respectively R2. Downstream of the analog-digital converters, there are two memories 60, 62 and a switching circuit 56 controlled by the circuit 32.

I claim:

1. A device for measuring duration of a time slot between a start signal (D) and a stop signal (F), comprising:

a first clock for supplying pulses with a period T;

a second clock, whose pulses are shifted with respect to those of said first clock;

a digital circuit for counting number of pulses of said first clock which are followed by a complete period T and which occur between said start signal (D) and said stop signal (F), and for counting number of pulses of said second clock which are followed by a complete period T, which occur between said start (D) and said stop signal (F);

an analog circuit for determining: (1) time t1 separating said start signal (D) and start of first pulse of said first clock commencing after (D), (2) time t2 separating said stop signal (F) from end of final period of said first clock completed before (F), (3) time t3 separating said start signal (D) and start of first pulse of said second clock commencing after (D), and (4) time t4 separating the stop signal (F) from end of final period of said second clock pulses completed before (F), and for converting analog data obtained into digital data;

a processing circuit for determining said duration of said time slot on the basis of data supplied by said digital circuit and those supplied by said analog circuit previously converted into digital data; and means for determining which of the counts performed on one of said two clocks is to be taken into account, so as to resolve any ambiguity situation which could lead to a clock period counting error.

2. A device according to claim 1, wherein said analog circuit also comprises:

a frequency dividing circuit connected to said first clock;

a first ramp generator controlled by an output signal of said frequency dividing circuit; and a first analog-to-digital converter for receiving a signal produced by said first ramp generator, and said start signal (D) and stop signal (F) of said time slot to be measured.

3. A device according to claim 2, and further comprising a flip-flop for transmitting said start signal (D) and stop signal (F) of said time slot to be measured to said first analog-to-digital converter.

4. A device according to claim 1, wherein said digital circuit further comprises:

a R-S flip-flop controlled on its set input by said start signal (D) delayed after passage in a first delay circuit and, on its reset input by said delayed stop signal (F) following passage in a delay circuit;

a first block having a first counter, a first D-flip-flop, a first AND gate, a first OR gate, a second AND gate, and means for time shaping of the signals;

a second block having a second counter, a second D-flip-flop, a third AND gate, a second OR gate, a fourth AND gate, a signal time shaping means; and a circuit for performing an OR function for detecting which of the outputs of said flip-flops has switched first.

5. A device according to claim 4, wherein:

said first counter in said first block is adapted to receive on its authorization input CE a counting order from said R-S flip-flop;

output data of said first counter are transmitted to said processing circuit by means of a switching circuit controlled by said OR gate;

said first D-flip-flop being controlled by said first OR gate and receiving said start signal (D) and said stop signal (F) and pulses from said first clock; and said first AND gate implements an AND function between an output of said first D-flip-flop, and the pulses from said second clock.

6. A device according to claim 4, wherein:

said second counter in said second block is adapted to receive on an authorization input (CE) a counting order from said R-S flip-flop;

the data from said counter are transmitted to said processing circuit by means of a switching circuit;

said second D-flip-flop being controlled by said second OR gate and receiving said start signal (D) and said stop signal (F), and pulses from said second clock ($H_2$); and said second AND gate implements an AND function between output of one of said D-flip-flops and pulses from said second clock ($H_2$).

7. A device according to claim 3, wherein said flip-flop is adapted to receive an output of an OR gate, whose inputs correspond to the delayed signals (D) and (F), and outputs of said first and third AND gates.

8. A device according to claim 7, further comprising a second analog-to-digital converter controlled by said output of said flip-flop and by an output of a second ramp generator, which is controlled by an output of a second divider of said pulses of said second clock.

9. A device according to claim 4, wherein said flip-flop is adapted to receive an output of an OR gate, whose inputs correspond to the delayed signals (D) and (F), and outputs of said first and third AND gates.

10. A device according to claim 9, further comprising a second analog-digital converter controlled by said output of said flip-flop and by an output of a second ramp generator, which is controlled by an output of a second divider of said pulses of said second clock.

11. A device for measuring duration of a time slot between a start signal (D) and a stop signal (F), comprising:

a first clock for supplying pulses with a period T, a second clock, whose pulses are shifted with respect to those of said first clock, a digital circuit for counting number of pulses of said first clock which are followed by a complete period T and which occur between said start signal (D) and said stop signal (F), and for counting number of pulses of said second clock which are followed by a complete period T, which occur between said start (D) and said stop signal (F), a first analog circuit, connected to the first clock, for determining: (1) time $t_1$ separating said start signal (D) and start of first pulse of said first clock commencing after (D), (2) time $t_2$ separating said stop signal (F) from end of final period of said first clock completed before (F), and for converting analog data obtained into digital data, a second analog circuit connected to the second clock for determining: (3) time $t_3$ separating said start signal (D) and start of first pulse of said second clock commencing after (D), and (4) time $t_4$ separating the stop signal (F) from end of final period of said second clock completed before (F), and for converting analog data obtained into digital data, a processing circuit for determining said duration of said time slot on the basis of data supplied by said digital circuit and those supplied by said analog circuits previously converted into digital data, and means for determining which of the counts performed on one of said two clock is to be taken into account, so as to resolve any ambiguity situation which could lead to a clock period counting error.

12. A device according to claim 11, wherein each of said first and second analog circuits comprises:

a frequency dividing circuit connected to a corresponding clock, a ramp generator controlled by an output of said frequency dividing circuit, analog-to-digital converter for receiving a signal produced by said ramp generator, and said start signal (D) and stop signal (F) of said time slot to be measured.

13. A device according to claim 12, further comprising a flip-flop for transmitting said start signal (D) and stop signal (F) of said time slot to be measured to said first and second analog circuits.

14. A device according to claim 13, wherein said digital circuit further comprises:

a R-S flip-flop controlled on its set input by said start signal (D) delayed after passage a first delay circuit and, on its reset input by said delayed stop signal (F) following passage in a delay circuit;

a first block having a first counter, a first D-flip-flop, a first AND gate, a first OR gate, a second AND gate, and means for time shaping of the signals;

a second block having a second counter, a second D-flip-flop, a third AND gate, a second gate, a fourth AND gate, a signal time shaping means; and a circuit for performing an OR function for detecting which of the outputs of said flip-flops has switched first.

15. A device according to claim 14, wherein:

said first counter in said first block is adapted to receive on its authorization input CE a counting order from said R-S flip-flop;

output data of said first counter are transmitted to said processing circuit by means of a switching circuit controlled by said OR gate;

said first D-flip-flop being controlled by said first OR gate and receiving said start signal (D) and said stop signal (F) and pulses from said first clock; and said first AND gate implements an AND function between an output of said first D-flip-flop, and the pulses from said second clock.

16. A device according to claim 14, wherein:

said second counter in said second block is adapted to receive on an authorization input (CE) a counting order from said R-S flip-flop;

the data from said counter are transmitted to said processing circuit by means of a switching circuit;

said second D-flip-flop being controlled by said second OR gate and receiving said start signal (D) and said stop signal (F), and pulses from said second clock ($H_2$); and said second AND gate implements said AND function between said output of one of said D-flip-flops and pulses from said second clock ($H_2$).

17. A device according to claim 13, wherein said flip-flop is adapted to receive an output of an OR gate, whose inputs correspond to the delayed signals (D) and (F), and outputs of said first and third AND gates.

18. A device according to claim 14, wherein said flip-flop is adapted to receive an output of an OR gate, whose inputs correspond to the delayed signals (D) and (F), and outputs of said first and third AND gates.

* * * * *

UNITED STATES PATENT AND TRADEMARK OFFICE

CERTIFICATE OF CORRECTION

PATENT NO. : 5,717,659

DATED : February 10, 1998

INVENTOR(S) : Pascal Besesty

It is certified that error appears in the above-identified patent and that said Letters Patent is hereby corrected as shown below:

Claim 14, Col. 8, line 38, insert --in-- after "passage".

Claim 14, Col. 8, line 46, insert --OR-- after "second".

Signed and Sealed this

Eighteenth Day of August, 1998

Bruce Lehman

*Attest:*

BRUCE LEHMAN

*Attesting Officer*

*Commissioner of Patents and Trademarks*